US005236074A

United States Patent [19]

Gotaas

[11] Patent Number: 5,236,074

[45] Date of Patent: Aug. 17, 1993

[54] METHOD AND A MEANS FOR RECOGNIZING A COIN

[75] Inventor: Einar Gotaas, Oslo, Norway

[73] Assignee: Datalab Oy, Esbo, Finland

[21] Appl. No.: 852,190

[22] PCT Filed: Oct. 17, 1990

[86] PCT No.: PCT/NO90/00153

§ 371 Date: May 29, 1992

§ 102(e) Date: May 29, 1992

[87] PCT Pub. No.: WO91/06072

PCT Pub. Date: May 2, 1991

[30] Foreign Application Priority Data

Oct. 17, 1989 [NO] Norway ..... 894130

[51] Int. Cl.[5] ..... G07D 5/00; G07D 7/10

[52] U.S. Cl. ..... 194/331; 194/328

[58] Field of Search ..... 194/328, 329, 331

[56] References Cited

U.S. PATENT DOCUMENTS 3,921,003 11/1975 Greene .

FOREIGN PATENT DOCUMENTS

| | | | |
|---|---|---|---|
| 0311554 | 4/1989 | European Pat. Off. | 194/331 |
| 0416932 | 3/1991 | European Pat. Off. | 194/331 |
| 3335347 | 4/1985 | Fed. Rep. of Germany . | |
| 3711941 | 10/1988 | Fed. Rep. of Germany | 194/331 |
| 59-17691 | 1/1984 | Japan | 194/331 |
| 503337 | 2/1971 | Switzerland . | |
| 2071381 | 9/1981 | United Kingdom | 194/331 |
| 2071382 | 9/1981 | United Kingdom . | |

*Primary Examiner*—Michael S. Huppert
*Assistant Examiner*—William M. Hienz
*Attorney, Agent, or Firm*—Nixon & Vanderhye

[57] ABSTRACT

An optical coin detector uses the spatial and/or temporal periodic modulation imparted to incident light which is reflected from the coin due to the combined effect of the stamping on the coin and its motion past a detection area. Detection of modulated, reflected light takes part from the end edge of the coin or from one of its side surfaces, and is effected by using one light sensitive detector with an adapted line screen pattern arranged in front of the detector, or by using a detector array.

10 Claims, 7 Drawing Sheets

Figure 1:
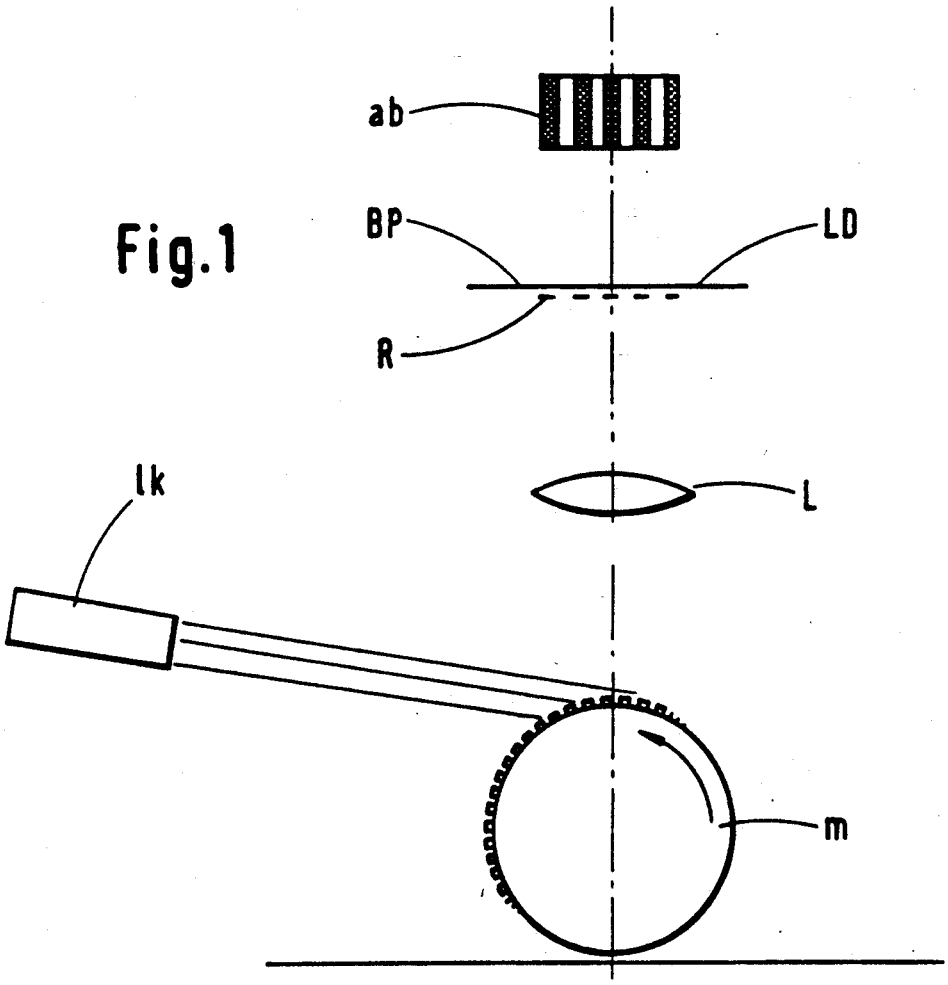
Figure 1:
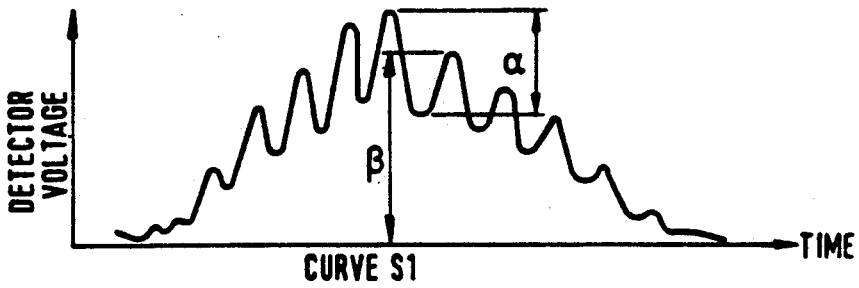
Figure 1:
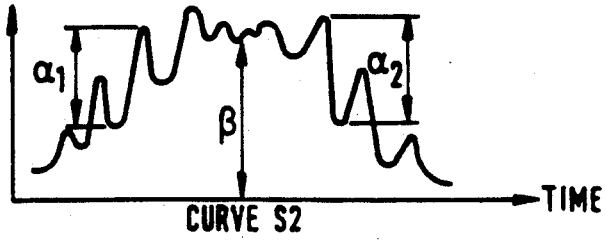

Coin: UK 5pence, diameter 23.6mm, groove distance 0.42mm
Line interval in screen pattern: 0.42mm
(Heightwise) coin positioning well adapted Coin: As in 5a
Screen pattern: As in 5a
Coin position: 0.3mm too high Coin: As in 5a, 5b
Screen pattern: As in 5a, 5b
Coin position: 0.6mm too high

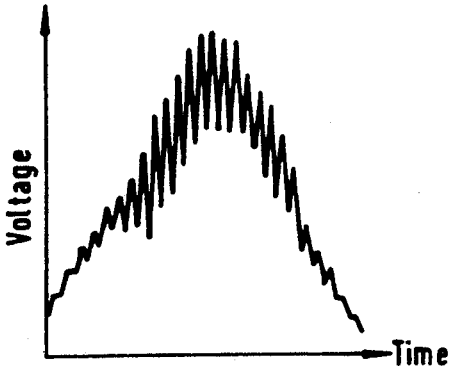

Coin: 1 shilling 1955, Ø 23.5mm
groove distance 0.40-0.41mm
Screen pattern: As in 5a-c
Well adapted coin position(heightwise)

Fig.5d

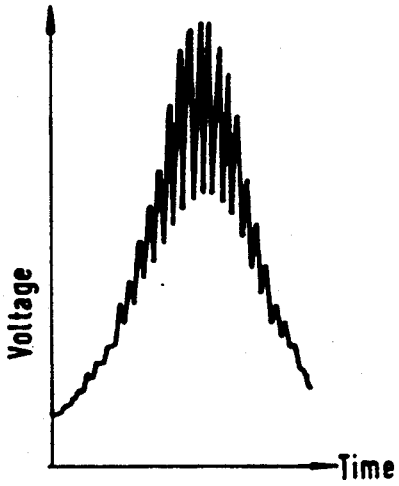

Coin: 1 shilling 1948, Ø 23.5mm
groove distance 0.43-0.44mm
Screen pattern: As in 5a-d
Well adapted coin position

Fig.5e

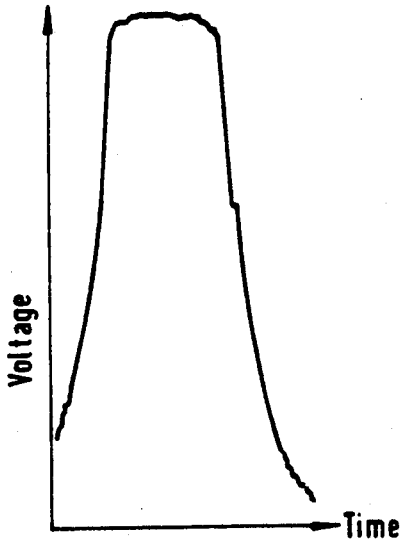

Coin: 1 DM, Ø 23.5mm
Without grooves, but edge stamping
Screen position: As in 5a-e
Coin position: Height adapted.
Besides, adapted so as to make
edge stamping "invisible" to sensor.

Fig.5f

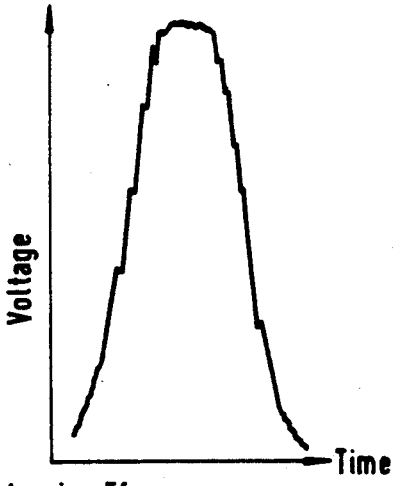

Coin: As in 5f
Screen pattern: As in 5a-f

Coin position: Height adapted, but
also such that the edge stamping
is partly "visible" to the sensor.

Fig.5g

Coin: UK 1£, Ø 22.53mm
groove distance 0.31mm
Screen pattern: As in 5a-g
Coin position: Height adapted Coin: As in 5h Screen pattern: As in 5a-h
Coin position: Not height adapted Coin: Finnish 20 pennia, Ø 22.42mm
groove distance 0.44
Screen pattern: As in 5a-i
Coin position: Height adapted Coin: As in 5j Screen pattern: As in 5a-j
Coin position: Not height adapted

METHOD AND A MEANS FOR RECOGNIZING A COIN

The present invention concerns a method and a means for recognizing a coin by means of an optical technique, as well as the use of a plurality of such means in an apparatus for approving and/or sorting different coins.

There exist today several different methods for automatical identification of coins. Two different use areas for the identification can be distinguished in a coarse manner:

First, in coin locks for use in vending and game machines. In this case only one or perhaps two or three different coins shall be identified and approved. A simple mechanical scanning is the most usual method. These mechanical coin locks have turned out to be robust and reliable. However, a purely mechanical coin lock will often be limited as to how many different coins can be checked in one and the same coin input system.

Secondly, also genuineness checking and value sorting of coins in banks is a large field where there is a need for automatic treatment of the coins. In such a sorting machine it is necessary to be able to handle many different coins in a mixture at the same time. Typical sensor techniques used for this purpose are: optical size measurement (thickness and diameter), magnetic alloy testing and ultrasound thickness inspection.

The problem in a coin detector is that the sensor does not know the orientation of the coin as it passes the sensor. The coin will also have a rotating movement as it passes the detector. The previously mentioned sensors all operate in such a manner that the orientation of the coin in the sensor area is indifferent. (Of course, the coin will always be oriented in a plane.)

The idea of the present invention is based upon a recognition of the pattern which has been stamped into the coin. This is possible for quite a few coin types, and for these coins the sensor in accordance with the invention will provide good reliability.

From British Patent 1.582.847 there is known a technique of optical detection of a "groove pattern" in coins. The gist of this patent is that a smooth surface reflects light in a more oriented manner than a grooved surface.

The disadvantage of this technique is the requirement for a relatively stable electronic equipment for detection of the differences. However, the most essential deficiency in relation to the present invention is:

a) the prior art cannot distinguish between different groove sizes, b) nor can the prior art be utilized for studying other periodic patterns in other locations in the coin rolling by.

From German Offenlegungsschrift DE 33 35 347 is known an optical coin testing device which in one of its embodiments directs light obliquely onto the coin edge i.e. obliquely in relation to the coin plane, and uses reflected light from the edge for recognizing the coin. A line raster is mounted in front of the detector. However, the ringing signal from the detector when an edge grooved coin of approximately correct size passes by, is merely evaluated as to the number of peaks in the signal, i.e. the ringing peaks are counted.

This prior art coin tester will probably not work very well with a coin like a 1 DM, due to the weak modulation which can be imparted to the light from the faint stamping marks on the coin edge, and the oblique illumination. Besides, it is possible to improve considerably on the signal processing, when taking into consideration the content of the outcoming signal from such a detector.

Very many coins have a pattern which completely or partly will repeat itself when the coin rotates, i.e. more often than once per full rotation. The simplest example hereof is of course the groove pattern on the edge of many coins.

Considering a "classical" problem within this field, namely distinguishing the German coin 1DM from the British coin 5 pence, it is realized that the 5 pence coin has a groove pattern. On the opposite, 1 DM has a completely different, stamped periodic pattern with a long pattern repetition distance along the edge, which is also positively identifiable by means of the present invention.

Many coins also have a "pearl row" on its flat side, along the whole circumference, quite out toward the edge. Other coins may have a text with a standard letter interval all the way around the coin.

It is of course possible, independent from these characteristics, to take an optical image of a coin by means of a video camera, and then undertake an image recognition process. However, since the rotational orientation of the coin is unknown, the recognizing process will be both time consuming and probably rather expensive.

The present invention, however, puts into use the idea consisting in studying the substantially periodic characteristics of the coin. These characteristics will be independent of the orientation of the coin, and will in the most important embodiments of the invention actually not appear in a registerable manner to the sensor until the coin actually moves past the sensor device.

The method and the device for recognizing a coin in accordance with the invention is defined precisely in the enclosed patent claims.

Figure 2:
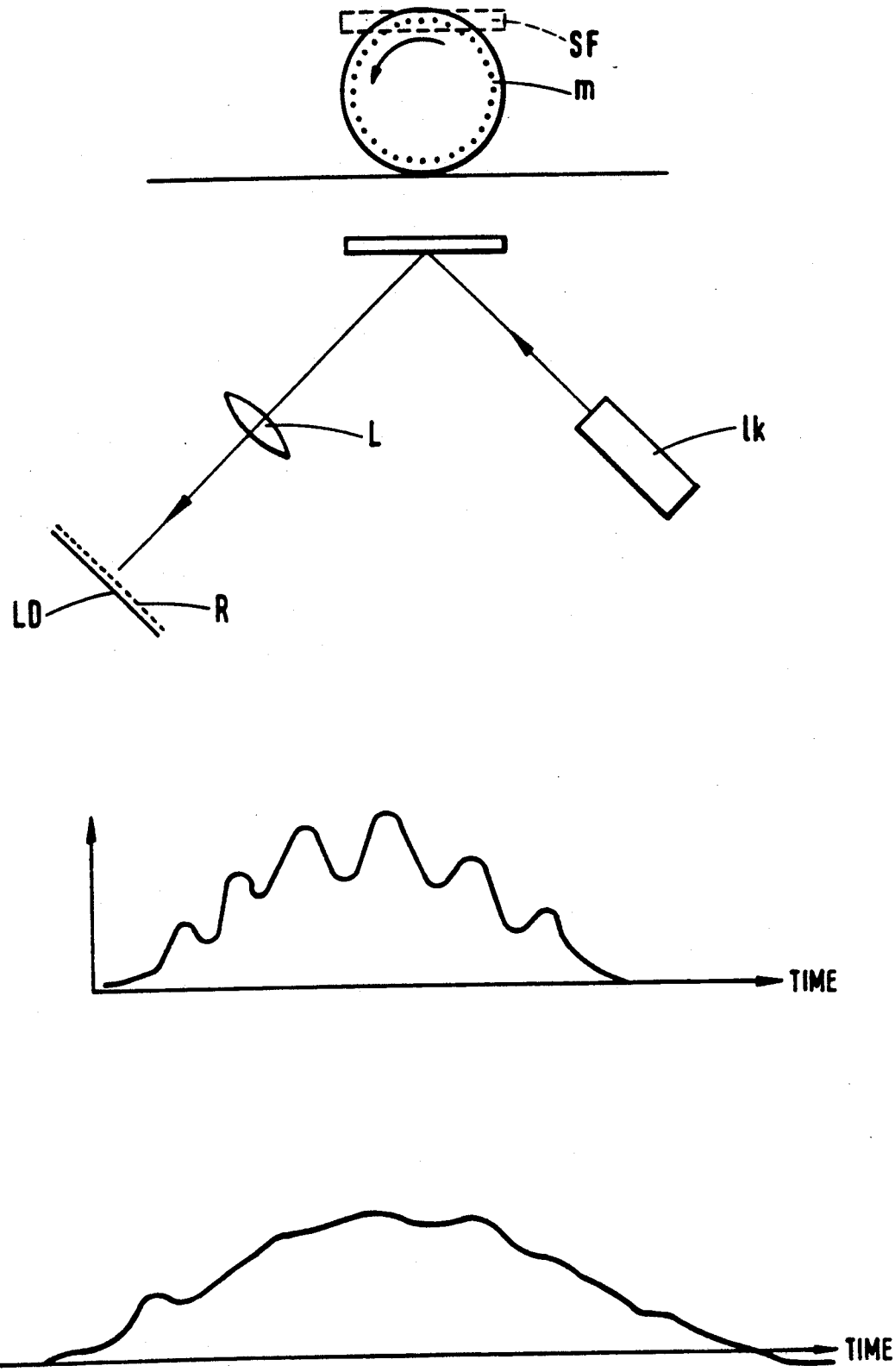
Figure 3:
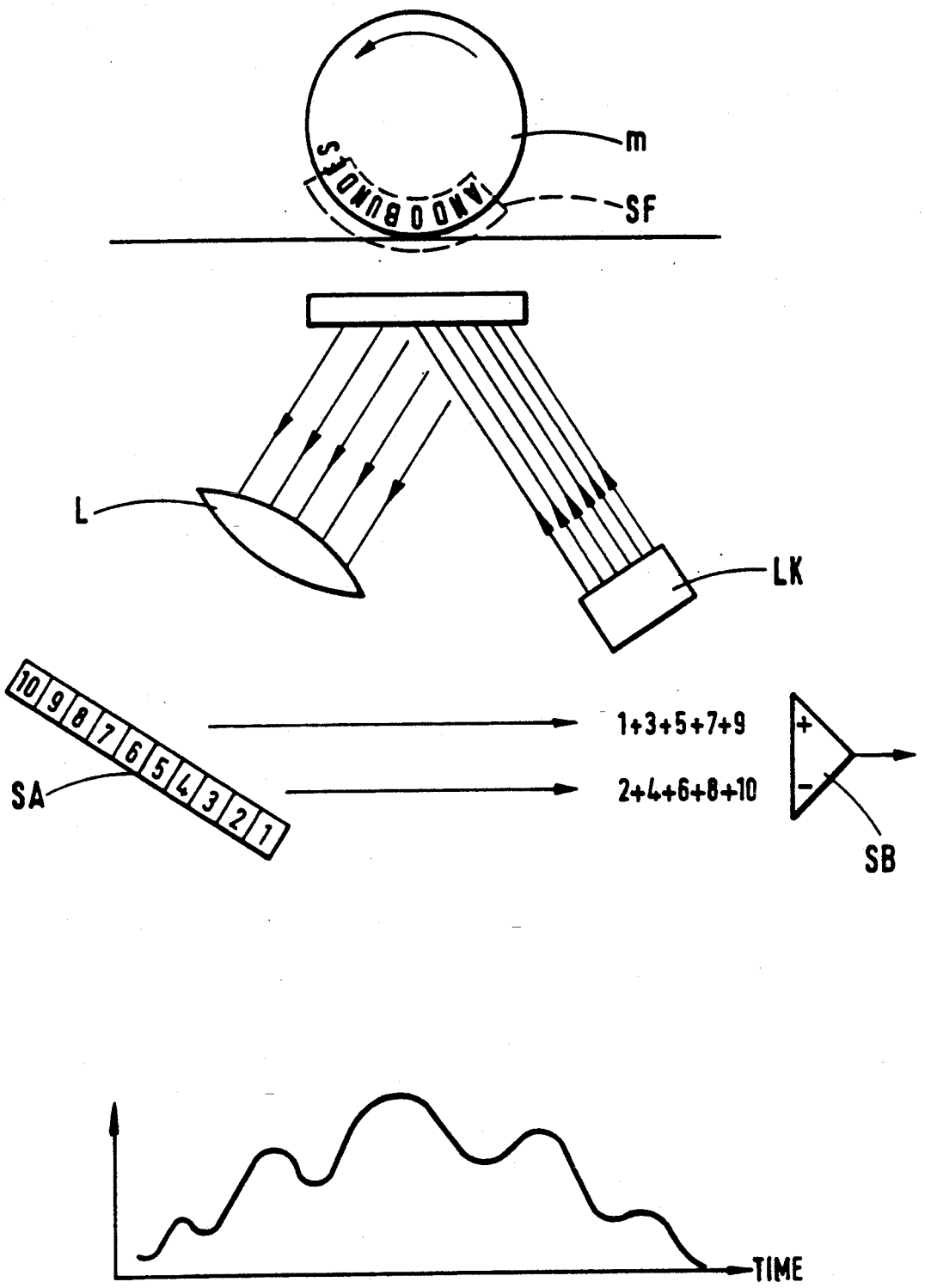
Figure 4:
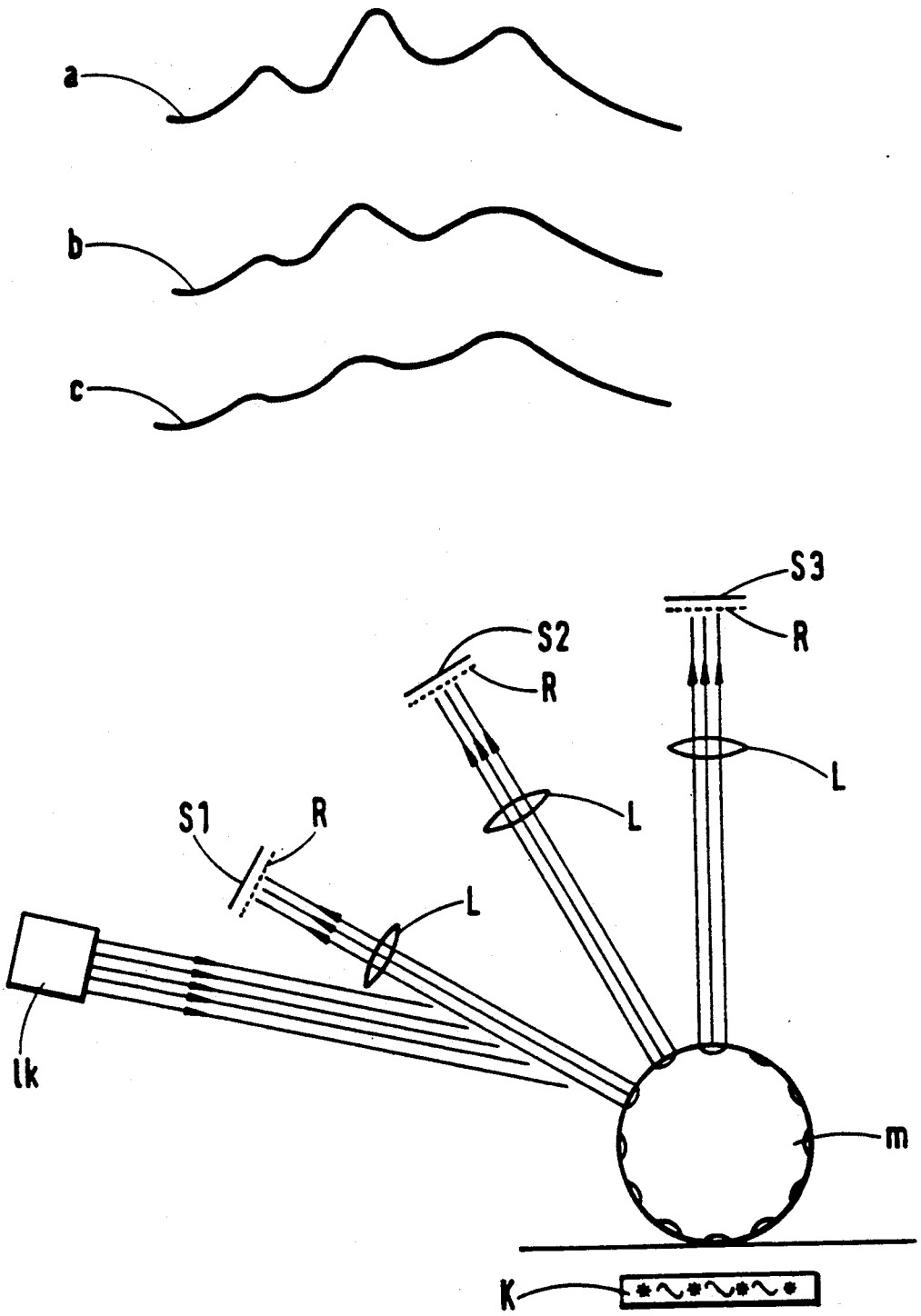

The invention will be more closely described with a mention of a few non-limitative embodiment examples and with reference to the enclosed drawings, wherein FIG. 1 shows an example of a simple optical arrangement in accordance with the present invention, with sensing of the coin edge, FIG. 2 shows an alternative arrangement in accordance with the invention, with sensing of an area of the flat side of coin, more precisely of a pattern close to the edge, FIG. 3 shows sensing of substantially peripherally arranged letters on a flat side of the coin, FIG. 4 shows an arrangement in accordance with the invention with sensing of a periodic stamp pattern on the coin edge, and FIG. 5*a–k* shows examples of measurement curves obtained for different coins, with sensing of the coin edge.

In FIG. 1 there is shown a simple and appropriate optical configuration for sensing the end edge of a coin rolling in a chute past the sensor field. A light source lk providing nearly parallel light, illuminates the edge of the coin m. Light is reflected through the lens L, and a sharp image of the coin edge is formed in the image plane BP. The light sensitive sensor LD is also situated in this plane.

An image of the coin edge is formed on sensor LD. Because the light source illuminates the coin obliquely, the image will consist of pronounced light and dark lines. The image is shown at ab.

A screen line pattern R is then laid over the detector, which screen pattern has the same interval between lines as the image from the coin to be detected. As the coin passes the sensor in a rolling manner, the sensitive area of the light detector will alternately be strongly or weakly illuminated, depending on how the screen pattern is positioned in relation to the image. When the "light" lines coincide with the dark lines in the screen pattern, the sensor LD will be illuminated minimally. When the light reflected lines coincide with the intervals in the screen pattern R, the sensor LD is illuminated maximally.

Curve S1 shows the signal output from the sensor. The signal will consist of two part curves. There is a single-top low frequency curve (height $\beta$) due to the fact that light enters the detector. This curve will have superposed a very fast oscillation (maximum amplitude $\alpha$) due to the fit between the coin groove pattern and the screen line pattern.

If the coin has the correct diameter, i.e. if the top of the coin is imaged sharply, the swift superposed oscillations will have their maximum value $\alpha$ in the same place as the low frequency single-top curve.

Curve S2 shows the signal if the coin is larger than the size for which the optical system has been focused. The swift signal has its maximum values $\beta_1$ and $\beta_2$ before and after maximum of the single-top curve. The reason is that the coin has two positions with optimum distance to the optical system.

It appears from the measurement examples d and e below (FIG. 5*d, e*) how the measurement curve comes out if the coin diameter is correct, while the groove period does not fit with the line interval in the screen pattern, example e (FIG. 5*e*) showing a good fit to the line intervals in the screen pattern, while example d (FIG. 5*d*) shows a not so good fit. The high frequency signal becomes weaker due to the misfit, and it "disperses" somewhat along the low frequency top.

In this arrangement or configuration it is to be noted that the coin is identified in the following four manners:

the coin has grooves, the grooves have correct intervals, because the image is sharp, the coin must have the correct diameter, and because the maximum values coincide, the coin has the correct diameter.

FIG. 2 shows a corresponding measurement of a pearl band arranged peripherally on the flat side of a coin. This configuration poses somewhat larger demands on the optical construction, but works in the same manner as the first mentioned embodiment in other respects.

It is to be noted that the measurement of the diameter improves substantially in this case in relation to the first embodiment, since in this case it is not the missing depth of field of the optical device which is used for detecting the correct diameter. If the diameter is wrong, the detector will in such a case see no periodic pattern, because no pattern exists in that which is seen by the sensor. (A too small coin will be able to pass below the field of view, and a too large coin will possibly place the parallel-moving upper part of the pearl band above the optical field of view.)

As appears from this figure, here is also utilized a light source lk which directs approximately parallel light toward the detection area, where the coin comes rolling by. When the coin enters the detection area, light is reflected through the lens L and toward the image plane of the detector LD. Right in front of this image plane is located a screen line pattern which is adapted to the point interval in the pearl band. Two curved shapes are shown in the figure. The upper curve shows the shape of a signal from a detector with a front screen pattern, when a coin with a correct pearl band passes the detection area. The curve below shows an example of a signal as it appears if a coin with a wrong pattern interval in the pearl band or no pearl band at all passes the detection area. A distinct and recognizable curve shape is obtained when the correct coin passes the detector.

In FIG. 3 there is shown an arrangement for investigating a coin with a periodic stamp pattern, for instance letters on a flat side. Many coins have a text which is arranged substantially peripherally and with substantially equal distance between each letter. The light reflection from the flat area between each letter and from the letter itself in a direction toward a detector will exhibit a clear difference in intensity. Thus, in this case it is the letter distance or interval which is the repetition interval of the pattern. In principle the detection is undertaken in the same manner as in the previous cases, but because the letter interval, i.e. the pattern interval is much larger than in the cases with grooves on the edge and a pearl band on the flat side close to the edge, the curvature of the outer edge of the coin will change the detector pattern. In this case it is not practically feasible to use only one detector with a front screen pattern for the recognizing procedure. The reason is that a larger part of the coin arc is scanned. However, this problem is solved quite simply by using several sensors for the detection. These sensors are coupled together electronically in order to recognize the periodic pattern which appears when the coin passes by.

From the figure it appears that substantially parallel light from the light source LK illuminates the coin obliquely, approximately as in the preceding case. An image of the coin is formed on the sensor array SA. Moreover, a shield is set up in such a manner that the sensor array SA has a field of view SF which covers an arcuate outer part of the coin.

In the image on the sensor array there will be formed light and dark areas, because the spaces between the letters on the coin reflect light well toward the array. The elevated parts (i.e. the letters) of the coin will reflect light to a lesser degree in the direction of the array.

The coin is expected to comprise letters with substantially equal distance around the whole periphery. When such a coin passes by the field of view of the sensor array, the single sensors of the array will alternately see light and dark parts. The distance between each detector in the array has been selected equal to the imaged pattern distance.

The signal from detectors no. 1, 3, 5 etc. are added, while the signals from detectors no. 2, 4, 6 etc. are subtracted. This is shown schematically at the signal processing means SB.

Because the imaged pattern distance and the detector distance are equal, there will be achieved an amplification of the signal which is proportional to the number of sensor elements viewing one part of the pattern simultaneously.

It is clear that this method provides a somewhat poorer detection security than the two first mentioned configurations. This is because a smaller number of periods of a periodic signal is used to identify the coin.

In FIG. 4 there is shown a setup for investigation of a coin containing a periodic stamp in its end edge, i.e., not grooves, but a pattern of repeated, stamped figures with a certain distance therebetween. This configuration has several similar features with the two previous ones, but is mentioned because this setup is favourable concerning the classical problem previously mentioned, namely distinguishing the German coin 1 DM from the British 5 pence. The 1 DM coin has a periodic stamp K comprising alternately a star and a lying S on the edge of the coin, see FIG. 4. In this case one also looks at the edge of the coin, just like in the first case. But due to the large pattern distance here in question, the configuration is a little different. The sensor device must be adapted geometrically, in such a manner that it is able to recognize such an edge stamping K with a large pattern distance.

Similar to the first case, the light source lk provides substantially parallel light, which is reflected from the coin edge. Three sensor elements, S1, S2 and S3 are positioned so as to cover together a continuous field of view, however in such a manner that no single part-field of view overlaps with one of the other fields. Thus, each field lies just side by side with the next field. Each sensor element sees exactly one pattern width. The geometrical facts mentioned here, concern the case when a correct coin is located in the correct position for the investigation.

Each of the sensor elements is also equipped with a shielding R which is shape adapted to e.g. one of the pattern elements on the coin edge.

When the coin passes the sensor array, each sensor element will see the same section of the coin, but at different times. But because the sensor elements are located exactly one pattern distance apart, each respective one will see an approximately equal signal simultaneously.

The output signal from each of the three sensor elements are drawn at the top right of the figure, curves a, b and c. Each one of these curves will exhibit maximum "swift" amplitudes when the shielding of each particular sensor shows a maximum fit with the design stamped on the coin.

It is appropriate to make a logical interconnection with the signals from all three sensor elements S1, S2 and S3. This may be effected by either adding or multiplying the signals with each other. This is a per se well known correlation technique.

Figure 5A:
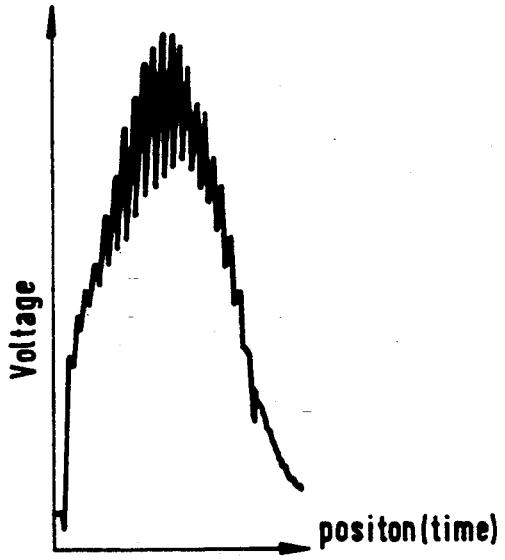

A few experiments have been made relating to the configuration with illumination and detection against the coin edge. In FIGS. 5*a–k* the results of such experiments are shown, and the experiments/figures will now be mentioned successively:

a) FIG. 5*a*

Figure 5B:
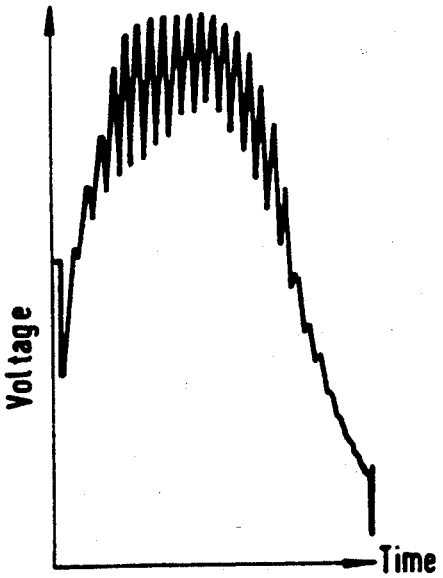

The figure shows detector voltage output as a function of the coin position (or time). In this case one has attempted to make such an optimum measurement as is possible regarding a British 5 pence coin. The coin diameter is 23.6 mm. The grooves on the coin edge has a pattern distance of 0.42 mm, and this distance is equal to the screen pattern line separation. In the diagram it appears that the amplitude of the superposed swiftly oscillating signal is about 10.5 units. It also appears that the superposed signal has its maximum value when the full signal is at a maximum value. This means that a very good adaptation has been achieved between coin diameter, optical system, screen line separation and groove separation in this case.

b) FIG. 5*b*

Figure 5C:
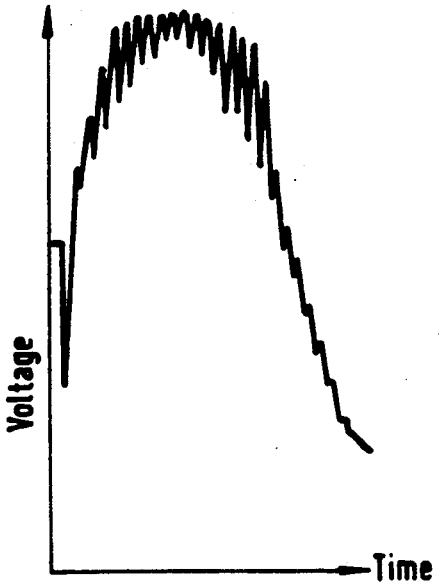

In this case the same measurement as under 5*a* has been made. The difference is only that a plastic strip of thickness 0.3 mm has been stuck to the coin rolling path, so that the top edge of the coin is positioned correspondingly closer to the sensor device. First, it appears that the whole curve shape is a little wider. Furthermore, the superposed, swiftly oscillating signal is a little smaller, maximum 7 units. It also appears that the maximum value of the superposed signal does not coincide with the maximum value of the complete signal.

c) FIG. 5*c*

The same experiment is made as in the two previous cases, however the rolling path has been built up a further 0.3 mm, so that the coin now will be about 0.6 mm out of focus.

It appears quite clearly that the superposed signal has its maximum value far away from the maximum value of the complete signal. The maximum value of the superposed signal appears when the distance to the focus point is exactly the distance provided by a correct coin.

It is also noted that the amplitude of the superposed signal is smaller in this case, because the coin edge when located at the correct distance from the optical system, does not exhibit the correct angle.

Thus it appears that this sensor configuration can be used for an extremely accurate measurement of the diameter. Firstly, the top of the curve shape is altered when the system is out of focus, and secondly, if the curves had shown the connection between the coin position and the signal from the edge, it would appear that the time position of the edge signal is changed very much when the diameter is altered.

d) FIG. 5*d*

The curve shown here has been recorded from a 1 shilling coin from 1955. The coin diameter is 23.5 mm, and the groove separation along the edge is about 0.40–0.41 mm. The line screen pattern is the same as previously used, and it appears that the superposed signal from the groove pattern is a little smaller than previously, here about 8 units. This is due to the non-optimum fit between the screen pattern and this coin. However, the deviation is so small that a rather good measurement curve is achieved. However, there is no problem distinguishing this coin from the coin used in the three previous experiments. The possibilities of coin identification thus seem to be very good.

e) FIG. 5*e*

This curve has been recorded from a 1 shilling coin from 1948. The diameter is the same as in the previous case, i.e. 23.5 mm, but the groove separation is different, namely 0.43–0.44 mm. Since still the same screen pattern is used, with line separation 0.42 mm, a better fit is obtained again. Thus, this measurement indicates actually that the screen pattern positioned in front of the detector ought to be equipped with a somewhat smaller line separation in order to be an optimum fit with the 5 pence coin, due to the optical system.

f) FIG. 5*f*

This curve appears when a German 1 DM coin passes the sensorfield. The diameter of this coin is 23.5 mm, and the edge is without grooves. The coin edge has some stamping, but the coin passes the sensor field in such a manner that the sensor only sees a section of the coin edge without stamping.

It appears that the signal amplitude is large. The reason is of course that the coin reflects light rather well. (This is the phenomenon utilized in the previously mentioned prior art of detecting grooves/no grooves on a coin).

g) FIG. 5*g*

Here the preceding experiment is repeated, only with the change that the German coin passes the optical system in such a manner that the sensor sees a small part of the star figure which is part of the stamped pattern along the coin edge. A trace of high frequency signals now appears. This is because the stamping contains distances within the same range as the screen pattern line separation.

Figure 5H:
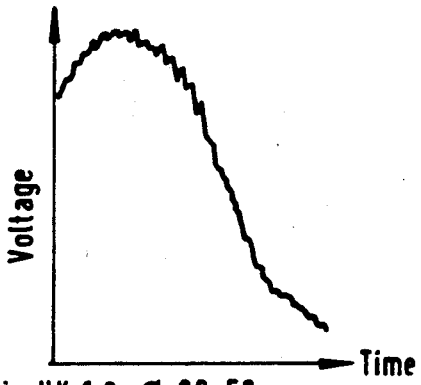

It should be noted that it is possible to make a positive identification of e.g. a 1 DM coin if a screen pattern is used, or possibly a sensor array, which is adapted to the pattern on the coin.

h) FIG. 5*h*

Figure 5I:
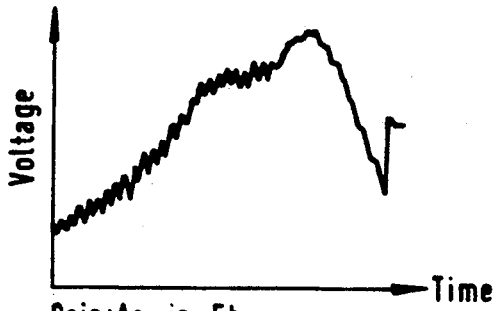

The curve appearing here shows the signal from a 1£ coin. The coin groove pattern has a dimension of 0.31 mm. The coin diameter is 22.53 mm, and the coin has been adjusted to the correct height in relation to the optical system. The groove pattern appears where the main signal has its maximum value. But because the screen pattern does not fit with the groove pattern, the signal is small.

i) FIG. 5*i*

Figure 5J:
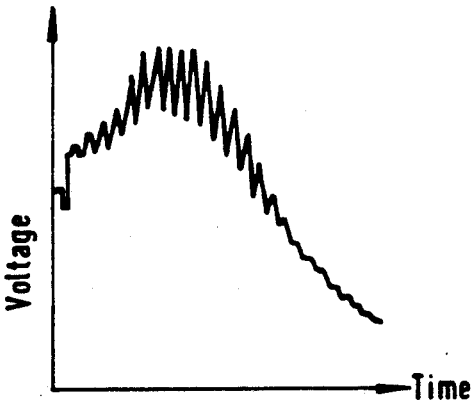

Here is shown a signal from the same point as in the preceding experiment, namely a British 1£ coin. The height has not been adjusted in this case. This means that the coin surface is far out of focus. It is noted that the screen pattern signal appears in an area positioned in another place than the top of the main curve. It is possibly a little strange that a superposed signal appears at all, since the coin edge is far out of focus. It is not impossible that there appears on the sensor a somewhat unsharp image which contains roughly half of the screen pattern line separation. It is to be noted that when the coin surface is situated further away from the lense, the magnification of the system will change.

j) FIG. 5*j*

Figure 5K:
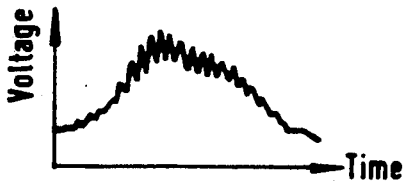

This signal is recorded from a 20 pennia (Finnish coin). The coin diameter is 22.42 mm. The groove separation is 0.44 mm. The height has been correctly adjusted, and a good signal appears, because the screen pattern is rather well adapted.

k) FIG. 5*k*

Here is shown the signal appearing when the same coin is used as in the preceding case, however with non-adjusted height. Thus the coin edge is far out of focus for the optical system.

The experiments show that the present invention is practically applicable. The experiments have been made using a relatively poor optical system, and possibilities for improvement in this field are quite obvious.

So far, substantially a rolling movement of the coin has been mentioned. However, there is no intention of limiting the invention to such a rolling movement, since the invention also comprises the possibility that the coin may move either in a sliding, purely translatory motion, in a free fall, i.e. a ballistic path, or in a type of motion which is something between the mentioned possibilities. As long as it is possible to sense a periodic modulation in reflected light due to a combination of the coin stamping and its type of motion, this will be comprised in the principle of the invention. For example, a coin may have a stamping in the form of concentric rings, which rings will create a periodic modulation in the reflected light during a fall or a purely translatory movement past a sensor area.

As a natural variant of the invention, a screen pattern with a varying line separation may be used. By contrasting the detector signal and the coin position, an effective coin recognition can then be achieved by using merely one such screen pattern for several different coin types, because the coin groove separation will possibly fit together with the line separation at a certain location in the screen pattern.

However, normally the utilization of any of the previously mentioned embodiments of the invention will take place in an apparatus for approving and/or sorting of a number of different coins, in such a manner that several successive such sensor devices are incorporated in the apparatus.

I claim:

1. A method for recognizing a coin moving along a path in an apparatus for approving and/or sorting coins, wherein at least one area of the coin edge has a stamped pattern which reflects light from an incident light beam from a light source and the reflected light is sensed by a light detection means, the stamped pattern having periodic characteristics capable of being sensed by reflected light, the method including the steps of:

directing said incident light beam substantially in the plane of the coin to illuminate said coin edge area substantially along an arc of the coin and at least over a part of the path of movement of the coin;

disposing a raster between the light detection means and the coin in the path of the reflected light;

using the light detection means to sense light reflected from said coin edge area along a direction substantially in the plane of the coin and a periodic modulation of the reflected light due to the periodic characteristics and motion of the coin;

generating a signal from said light detection means comprising substantially a single-peak time variable component and a high-frequency component superposed thereon, said high-frequency component being related substantially to the periodic characteristics of the coin; and evaluating the correlation between maxima of the high-frequency component and of the single-peak component as a basis for coin recognition.

2. A method according to claim 1 wherein the maxima of the high-frequency component are defined by means of the maximum intensity amplitude as measured separately in the high-frequency component, and the correlation is effected by determining the intervals between such high-frequency maxima and the single-peak component maximum.

3. In an apparatus for proving and/or sorting coins, an optical apparatus for recognizing a coin moving along a path wherein the coin has a stamped pattern along a coin edge having periodic characteristics capable of being sensed by reflected light, comprising:

a light source for directing a light beam to illuminate at least one area of the coin edge during at least a part of the movement of the coin along the path, said light source being arranged such that the optical axis of the light beam lies substantially in the plane of the coin and is directed so as to obtain illumination of said coin edge area substantially along an arc of the coin and at least over a part of the coin path;

a light detection means for sensing reflected light from said one coin edge area, including periodic modulation of said light reflection due to a combination of the periodic characteristics along the coin edge and the coin motion and providing a signal responsive thereto, said light detection means including a front-mounted line raster and at least one light sensitive detector element behind said raster and having an optical axis lying substantially in the plane of the coin;

said signal including substantially a single-peak time variable component and a high-frequency component superposed thereon, said high-frequency component being related substantially to said periodic characteristics of said coin; and evaluation means for evaluating a correlation between maxima of the high-frequency component and of the single-peak component wherein said correlation serves as a basis for coin recognition.

4. An optical apparatus according to claim 3 wherein said light detection means is adapted to sense the definition and/or the magnification of the image of the coin edge pattern for checking correctness of the coin diameter.

5. An optical apparatus according to claim 3 wherein the line separation in said raster is adapted to a typical repetition distance of a substantially periodic pattern appearing in the coin edge area.

6. An optical apparatus according to claim 3 wherein the line separation in said raster is variable along one of the linear dimensions of said raster.

7. An optical apparatus according to claim 6 wherein the line separation in said raster is variable in a direction transverse to the main line direction.

8. An optical apparatus according to claim 7 wherein the line separation in said raster is variable with a linear decrease of the line separation.

9. An optical apparatus according to claim 3 including a chute for rolling the coin and defining the coin path, the modulation in the sensed reflected light being due to a combination of the stamped pattern on the coin edge and the combined translatory and rotating path motion of the coin along said chute.

10. An optical apparatus according to claim 3 including means defining a free fall or sliding chute for effecting solely translatory motion of the coin, whereby the modulation in the reflected light is due to a combination of the stamped pattern on the coin edge and the translatory coin path motion.

* * * * *